US012054956B2

(12) United States Patent
Clement

(10) Patent No.: US 12,054,956 B2
(45) Date of Patent: Aug. 6, 2024

(54) SEPARATOR, TOOL AND METHOD FOR LAYING TILES OR OTHER COATING ELEMENTS

(71) Applicant: CMC Elements ApS, Silkeborg (DK)

(72) Inventor: Ole Clement, Silkeborg (DK)

(73) Assignee: CMC Elements ApS, Silkeborg (DK)

( * ) Notice: Subject to any disclaimer, the term of this patent is extended or adjusted under 35 U.S.C. 154(b) by 251 days.

(21) Appl. No.: 17/862,633

(22) Filed: Jul. 12, 2022

(65) Prior Publication Data

US 2022/0341191 A1 Oct. 27, 2022

Related U.S. Application Data

(63) Continuation of application No. PCT/DK2021/050035, filed on Feb. 3, 2021.

(30) Foreign Application Priority Data

Feb. 11, 2020 (DK) ..... PA 2020 00166

(51) Int. Cl.
*E04F 21/00* (2006.01)
*E04F 21/22* (2006.01)

(52) U.S. Cl.
CPC ..... *E04F 21/0092* (2013.01); *E04F 21/22* (2013.01)

(58) Field of Classification Search
CPC ..... E04F 21/0092; E04F 21/22
See application file for complete search history.

(56) References Cited

U.S. PATENT DOCUMENTS 4,112,636 A 9/1978 Hays
4,397,125 A 8/1983 Gussler, Jr.
7,257,926 B1 * 8/2007 Kirby ..... E04F 21/22 52/749.11
7,954,300 B1 * 6/2011 Kufner ..... E04F 21/0092 52/749.11
8,079,199 B1 * 12/2011 Kufner ..... E04F 15/02022 52/749.11

(Continued)

FOREIGN PATENT DOCUMENTS

EP 3004488 A1 4/2016
ES 1106110 U 4/2014

(Continued)

OTHER PUBLICATIONS

International Preliminary Report on Patentability, International Application No. PCT/DK2021/050035, Aug. 11, 2022, 15 pages.

*Primary Examiner* — Mark R Wendell
(74) *Attorney, Agent, or Firm* — Elevated IP, LLC

(57) ABSTRACT

A method for laying tiles or other coating elements where a separator is placed under, above and between adjacent tiles during the process of cementing the tiles to a surface. The method includes:

- placing a metal rod of a one-piece tile separator between two adjacent tiles, with a metal base part under adjacent tiles,
- sliding a tile holder onto the metal rod, where one-way steel jaws opposite each other in the tile holder are pressured towards two opposed smooth surfaces of the metal rod,
- preventing return movement of the tile holder along the metal rod while the opposed one-way steel jaws indent the softer metal surface of the metal rod.

20 Claims, 10 Drawing Sheets

(56) References Cited

U.S. PATENT DOCUMENTS

| | | | | |
|---|---|---|---|---|
| 8,429,879 | B1 * | 4/2013 | Hoffman | E04F 21/0092 52/747.11 |
| 9,874,032 | B1 | 1/2018 | Chen | |
| 10,378,218 | B2 * | 8/2019 | Vandenberg | F16B 5/0088 |
| 10,577,813 | B2 * | 3/2020 | Dahill | E04F 21/22 |
| 2014/0325935 | A1 * | 11/2014 | Hoffman | E04F 21/20 52/749.11 |
| 2015/0027082 | A1 | 1/2015 | Hoffman et al. | |
| 2015/0211243 | A1 * | 7/2015 | Irvine | E04F 15/02 52/749.11 |
| 2015/0240504 | A1 * | 8/2015 | Hoffman | E04F 15/0215 29/244 |

FOREIGN PATENT DOCUMENTS

| | | | |
|---|---|---|---|
| WO | 2014022889 | A1 | 2/2014 |
| WO | 2019071308 | A1 | 4/2019 |

* cited by examiner

SEPARATOR, TOOL AND METHOD FOR LAYING TILES OR OTHER COATING ELEMENTS

CROSS REFERENCE TO RELATED APPLICATIONS

This application is a continuation under 35 U.S.C. 111 of International Patent Application No. PCT/DK2021/050035, filed Feb. 3, 2021, which claims the benefit of and priority to Danish Application No. PA 2020 00166, filed Feb. 11, 2020, each of which is hereby incorporated by reference in its entirety.

FIELD OF INVENTION

The present invention relates to a method for laying tiles and to a device and tool for laying tiles.

BACKGROUND

U.S. Pat. No. 4,397,125 discloses a method for laying tiles or other coating elements whereby a tile separator is placed under, above and between adjacent tiles during the process of cementing the tiles to a surface. The tile separator in this document is a two-part device with a base part adapted to be placed under a tile, and a rod part, which is welded to the base part and adapted to protrude between adjacent tiles. A tile holder is placed over the tile separator, and by use of a thumb screw and a bolt connected to the protruding part, the tile holder may be pressed towards the part of the tile holder placed below the tiles. This prior art method is cumbersome to use, and tile separators are not easily stored. In addition, their production is difficult as it requires two separate parts to be made and later fused together.

Thus, there is a need for an improved tile separator, an improved tile holder and an improved method of laying tiles. A simple tool for tightening the tile holder and the tile separator is also desired.

BRIEF DESCRIPTION

The object of the present invention is achieved by a method for laying tiles or other coating elements whereby a separator is placed under, above and between adjacent tiles during the process of cementing the tiles to a surface. According to the invention, the method comprises the following further steps:

- place a metal rod of a one-piece tile separator between two adjacent tiles, with a metal base part under the adjacent tiles,
- slide a tile holder onto the metal rod, whereby one-way steel jaws placed opposite each other in the tile holder are pressed against two opposed smooth surfaces of the metal rod,
- prevent the return movement of the tile holder along the metal rod while the opposed one-way steel jaws indent the softer metal surface of the metal rod.

The action between the one-way steel jaws and the metal rod results in indents formed in the metal rod as the steel jaws are made from a material that is harder than the metal of the metal rod. The one-way steel jaws are part of the tile holder and are arranged at opposite positions on either side of the metal rod. They are pressed against each other as a stretched metal rod ensures pressure between the base part and the tile holder.

Furthermore, according to a method, a metal rod of the one-piece tile separator is erected with respect to a base part of the one-piece tile separator by bending the metal rod with respect to the base part at a prearranged bending line. This may be performed immediately prior to installing the one-piece tile separator between tiles as they are cemented to a surface.

A method comprises the further steps of:

- adding a predefined tightening force between an outer end of the rod and the tile holder by pulling at the rod with a predefined pull force, away from the tiles, and pressing the tile holder downward towards the tiles with a similar but opposed force whereby the base part and the tile holder are urged towards each other from either side of the tiles,
- releasing the pull force between the outer end of the metal rod and the tile holder, while the pressure between the tile holder and the base part is maintained due to the indent of the one-way steel jaws on the one-piece tile holder into a softer metal surface of the metal rod.

The tightening force ensures that adjacent tiles are levelled with each other, due to the pulling force installed in the metal rod between the tile holder and the base part. The softer metal of the metal rod provides certainty that the tile holder with the steel jaws does not slide upwards and give way, but maintain the elastic extension installed in the metal rod between the tile holder and the base part. Thus, when the tile holder has been tightened, the tiles will be suspended between the base part and the tile holder, and thereby they shall be levelled with each other. The various elements of the method are to be carried out with metal pieces only. As opposed to plastic pieces, which are one-time use only, that cannot be re-used. The only piece which cannot be re-used one way or the other is the base part. However, as it is fabricated from aluminium, it consumes only a minute fraction of the energy and materials which are otherwise required to generate even a simple tiled surface.

In an embodiment of the invention, the predefined tightening force is applied to the metal rod by the action of at least one lever with a short arm and a long arm, whereby the at least one lever is turned with respect to a turning point, whereby the turning point is mounted in a lever base such that the short arm of the lever with an engagement structure shall lift the metal rod (engagement structure) with respect to the tile holder, while the long arm of the lever is moved towards the tiles. The attack of the engagement structure of the short arm shall ensure that a rod part which is even and smooth will be forcefully lifted when the lever is turned around the turning point due to added force on the short arm.

In an embodiment, the engagement structure is formed as a range of teeth, wherein the teeth are arranged and configured to be brought into engagement with the metal rod (engagement structure).

In an embodiment, the engagement structure is formed as a fork structure arranged and configured to be brought into engagement with a corresponding engagement member of the metal rod. The fork structure is arranged and configured to be brought into engagement with the corresponding engagement member of the metal rod in such a manner that a tightening force is applied to the metal rod by the action of at least one lever.

In an embodiment, the fork structure comprises two members of equal length spaced apart.

In an embodiment, the engagement member is a protruding portion of the metal rod.

In an embodiment, the metal rod comprises a protruding portion protruding from an intermediate member. In an embodiment, the engagement structure is formed as a fork structure and the engagement member is a protruding portion of the metal rod, the intermediate member of the metal rod is formed such that its width is in a size range where it fits within the space between the two members of the fork structure. Hereby when the fork structure engages the engagement members the two members of the fork can engage and provide lift to the protruding portion of the metal rod.

In an embodiment, the lever base is placed on a tile surface with the metal rod protruding through a hole in the lever base, and the lever base is pressed towards the tiles while the long arm is moved towards the tiles in order to provide a lifting force in the metal rod with respect to the base part. Thus, the lever base needs are not carried by a user but may rest on the tiles while the long arm of the lever is turned to produce the increased torque on the short arm. Thus, the lever base and the lever may be made from rather sturdy materials and still not cause undue strain on an operator.

In an aspect of the invention, a tile laying assembly is provided comprising a metal base part, a metal rod and a tile holder. It is preferred that the metal rod is integrally shaped with and erected from the base part, and that the tile holder is placeable onto the metal rod. Furthermore, the tile holder comprises one-way steel jaws adapted to prevent movement in one direction only between the metal rod and the tile holder, whereby the metal rod comprises two opposed smooth surfaces adapted to be indented by the one-way steel jaws in order to prevent the tile holder from moving away from the base part. The interaction between the steel jaws and the metal rod with indentations being produced by the steel jaws ensures that the tile holder is moved in one direction only with respect to the metal rod. Such one-way elements are known in some machine elements such as in self-locking and push-on retaining rings and need not be explained in further detail.

In an embodiment of the tile laying assembly, the base part and the metal rod both comprise integral wing segments adapted to be placed between adjacent tiles in order to ensure a uniform distance between tiles. The integral wing segments are easily provided from a blank and are instrumental in ensuring a minimum space between tiles.

In an embodiment, the wing segments on the metal rod protrude perpendicular away from the smooth surface adjacent to the base part. This allows the wing segments to always be placed between two adjacent tiles, when the base part is placed underneath two adjacent tiles with the metal rod protruding upward therebetween.

In an embodiment of the assembly, two wing segments protrude from the base part, both angled upward and placed at either side of the metal rod and extending in a plane which is perpendicular to the extension planes of the wing segments on the rod. When three tiles are laid to form a T-shape with the joints, one of the two wing segments may be placed between the tiles shaping the vertical part of the T-shape, while the wings on the rod parts may provide distance between the tile laid along the horizontal part of the T-shape and the two further tiles. When tiles are laid to form a cross with the joints, both the wing parts protruding from the base part shall be employed to ensure distance between the tiles forming the one leg of the cross, while the two wing sections at the metal rod shall ensure distance between the tiles forming the other leg of the cross.

In an aspect of the invention, the metal rod and the base part are punched out in one piece from an aluminium metal sheet blank. This allows for a ductile piece, which the user may easily shape by erecting the metal rod from the base part. Furthermore, it allows the user to press down the wing segments of the base part in case they are not to be used. In addition, the relative softness of aluminium allows steel jaws to easily form indents in the metal rod part when the one-piece rod and the base part are used with the tile holder.

In an embodiment of the tile laying assembly, it is preferred that the tile holder is punched out from a steel sheet metal blank.

This punching operation may be performed at a very low price, and the material used is also inexpensive.

In an embodiment, it is preferred that the one-way steel jaws of the tile holder are comprised of adjacently positioned opposed individual flaps angled upwards with respect to a tile contacting surface and spaced apart to accommodate a rod. The angling of the individual flaps ensures, that when it is attempted to pull the rod against the one way direction, the flaps are pressured against each other and only at very high forces will it be possible to pull the rod the wrong way through the one-way gap between the flaps making up the steel jaws.

In a further aspect of the invention, a one-piece tile separator is provided which comprises an integrally shaped metal rod and base part. It is further preferred that the metal rod and base part are arranged in the same extension plane, and that at a connection line between the base part and the metal rod, wing segments are provided at the metal rod to protrude at a normal to the extension plane of the rod, such that when the metal rod is tilted to be erected in order to be aligned with a normal to the base part, the wing segments shall provide a tilting guide. This allows the one-piece tile separator to be stored in a nearly flat configuration, and it ensures, that when an end-user shall erect the rod with respect to the base part, this is easily accomplished, and a correct angle between the two is arrived at due to the tilting guide function of the wing segments.

In a further aspect of the invention, a tile holder is provided which comprises a punched-out steel sheet element. It is preferred, that the punched-out element has two opposed one-way steel jaws, which are angled upward from a steel sheet plane, and that adjacent each steel jaw, at two sides thereof, a punched out through going opening is provided to allow a passage way on both sides of the opposed one-way steel jaws. This passageway allows the metal rod to be pushed through the opening between the steel jaws, while wing parts attached to the base of the rod may pass through the through-going openings.

The invention also concerns a tile laying tool which comprises a lever with a short arm and a long arm arranged to pivot around a turning point with respect to a lever base. According to this aspect of the invention the lever base has a flat even side adapted to abut a tile surface, and a hole in the lever base in said flat side whereby the short arm of the lever comprises an engagement structure in the form of a range of teeth arranged on the circumference of a circle, which circle is arranged co-centrically with the turning point. This allows a rod part to protrude upwards from a tile surface and into the hole, where the teeth of the short arm may attack the rod part, and lift it upwards away from the base part, while the flat even side of the lever base presses downward on the tiles due to momentum added to the long arm of the lever.

Hereby, a predefined tightening force is applied to the metal rod by the action of at least one lever with a short arm and a long arm, whereby the at least one lever is turned with respect to a turning point, whereby the turning point is mounted in a lever base such that the short arm of the lever with a range of teeth shall lift the metal rod with respect to the tile holder, while the long arm of the lever is moved towards the tiles.

In an embodiment, the engagement structure is formed as a fork structure arranged and configured to be brought into engagement with a corresponding engagement member of the metal rod. The fork structure is arranged and configured to be brought into engagement with the corresponding engagement member of the metal rod in such a manner that a tightening force is applied to the metal rod by the action of at least one lever.

In an embodiment, the engagement member is a protruding portion of the metal rod.

In an embodiment, the metal rod comprises a protruding portion protruding from an intermediate member.

Hereby, the tile laying tool fulfils the desire to have a simple tool for tightening the tile holder and tile separator by interacting with the metal rod constituting a part of a tile laying assembly.

In an embodiment, the tile laying tool comprises a regulation screw, that is rotatably mounted in a hole arranged in the long lever arm, wherein the distal end of the regulation screw is configured be brought into contact with the lever base and hereby prevent further movement of the lever.

In an embodiment, the tile laying tool comprises an attachable/detachable pin wherein the pin is arranged and configured such that when detached the pin remains attached to a shaft it is attached to, thus the tool becomes disassembled.

Hereby the tool can be easily and quickly disassembled for cleaning.

BRIEF DESCRIPTION OF THE DRAWINGS

The invention will become more fully understood from the detailed description given herein below. The accompanying drawings are given by way of illustration only, and thus, they are not limitative of the present invention. In the accompanying drawings.

DETAILED DESCRIPTION

Figure 1:
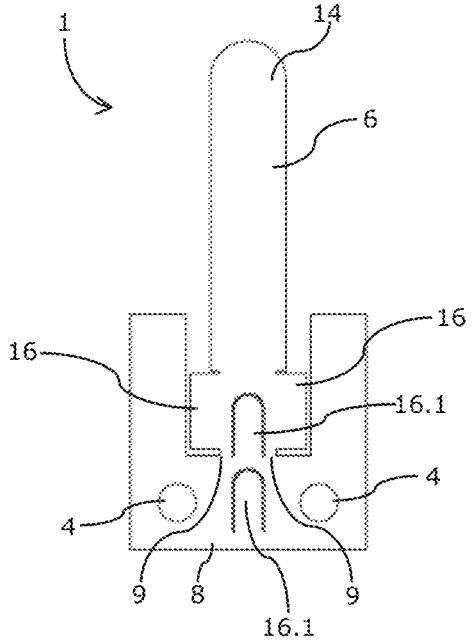
FIG. 1 shows a schematic plan view of a tile separator 1 in flat condition.

Referring now in detail to the drawings for the purpose of illustrating embodiments of the present invention, a schematic plan view of a tile separator 1 in flat condition is illustrated in FIG. 1. The flat condition is an intermediate step towards a usable item.

Figure 2:
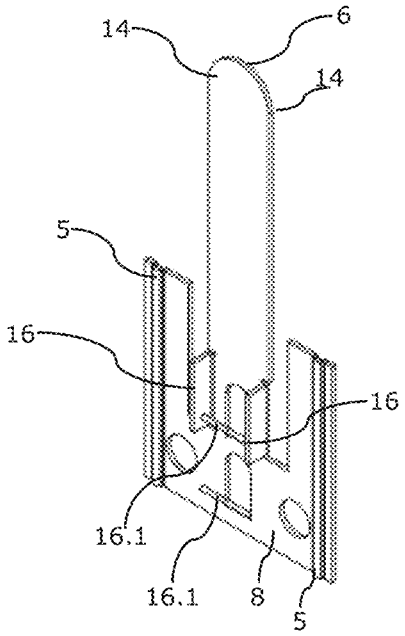
FIG. 2 shows a 3d view of a tile separator as shown in FIG. 1, and now with folded up wing segments and other parts.
Figure 2A:
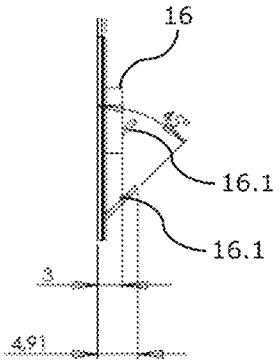
FIG. 2*a* is a section through part of the tile separator seen in FIG. 2, and with some measurements.
Figure 5:
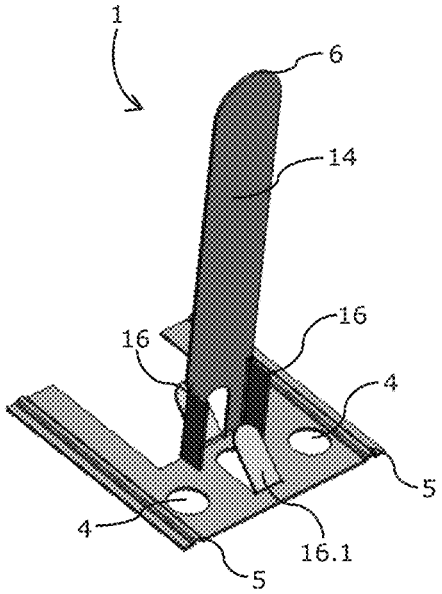
FIG. 5 shows a 3d rendition of a tile separator which has been folded up and is ready for use.

In FIG. 2 and FIG. 2*a* a 3d view of a tile separator as shown in FIG. 1 is disclosed, and now with folded up wing segments 16; 16.1 and other parts, and in this condition the element may be sold to the user, and still not take up excessive space, as it would, were it sold in the configuration ready to use shown in FIG. 5. In FIG. 2*a*, the folded up wing segments 16.1 on the base part are shown with an angle indicator, and here 45 degrees is the designated measure of the angle between the base part and the folded up wing segments 16.1.

Figure 3:
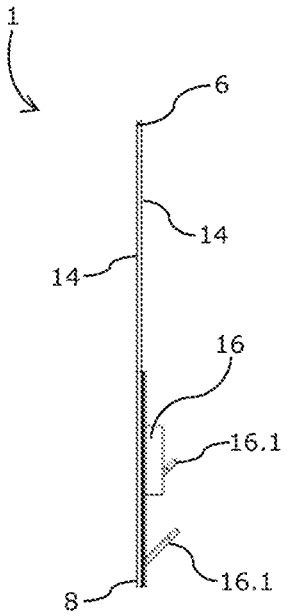
FIG. 3 is a side view of the tile separator shown in FIG. 2.
Figure 4:
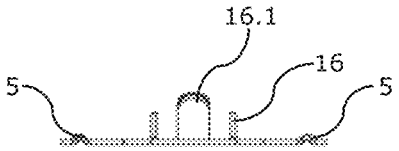
FIG. 4 shows an end view of the tile separator as shown in FIG. 2.

FIG. 3 is a side view of the tile separator shown in FIG. 2, and FIG. 4 shows an end view of the tile separator as shown in FIG. 2, and in FIG. 5 a 3d rendition of a tile separator 1 which has been folded up and is ready for use is disclosed, and here it may be observed that the rod part 6 has been erected to stand upwards from the base part 8. The step of bending the rod upwards to stand perpendicular up from the base part 8 is performed by the user prior to use of the one-piece tile separator. The separator 1 is made from an aluminium blank and thus the material is ductile, and the bending of the rod part 6 with respect to the base part is performed by hand without use of any tools. During the punch out operation, a bending line between the rod part 6 and the base part may be provided to ensure easy bending.

Also at the end of its use as a tile separator, the rod part 6 is removed from the base part 8 by pulling the rod 6 forcefully up from the tiles, in order to rupture the connection between the rod part 6 and the base part. The base part 8 shall stay under the newly laid tiles. The broken away rod part 6 may be added to an empty aluminium soft drink canister of the kind sold in many parts of the world, and often times collected for re-cycling of its aluminium content. Thus, no waist of any kind is generated by this tile separator.

There are two sets of wing segments 16; 16.1 and both serve as tile separators, when the tile separator is placed between tiles with the metal rod 6 placed between adjacent tiles. The wing segments 16 folded up from flaps protruding from the base of the rod 6 (see FIG. 1) are always in use and ensure that tiles placed at either side of the flat rod 6 have a minimum distance from each other. In this case, both the wing segments 16.1 protruding from the base part shall be folded back to be aligned with the base part 8, which is easily performed by hand or by simply pressuring the two aligned tiles gently downwards from above onto the base part 8.

If three adjacent tiles are placed with two tiles being aligned and facing a side edge of a third tile, the wing segments 16.1 of the base part may come into use, to ensure that the two aligned tiles are distanced apart by the width of one of the wing segments 16.1. The other one of the two wing segments 16.1 shall be folded down by the user to become aligned with the base part as it is shown in FIG. 1.

If four adjacent tiles are in play with corners thereof forming a cross, both of the wing segments 16.1 shall be in use. This is disclosed in FIG. 7, and at the left-hand side, an enlarged section shows the tile separator from above, and the wing segments 16.1 are shown to ensure the predetermined spacing between two sets of tiles in one direction whereas the wing segments 16 ensure the spacing between the tiles in the perpendicular direction.

It is noticeable, that one of the wing segments 16.1 protruding upwards from the base part is actually punched out from material originally forming part of the rod, at the base thereof, but set centrally, as seen in FIG. 1. This leaves less material for the formation of the link between the rod part 6 and the base part 8. In FIG. 1 this material comes out as two bridges 9. It is easy to provide a desired strength of these bridges 9, such that only a moderate force is needed to bend the rod part with respect to the base part 8 and also ensure that the force needed to brake away the metal rod 6 from the base part 8 is not too large.

Holes 4 are provided in the base part in order that cement may travel from one side of the base part to the other in case there is a need. Corrugations 5 may be provided in order to strengthen the base part.

Figure 6:
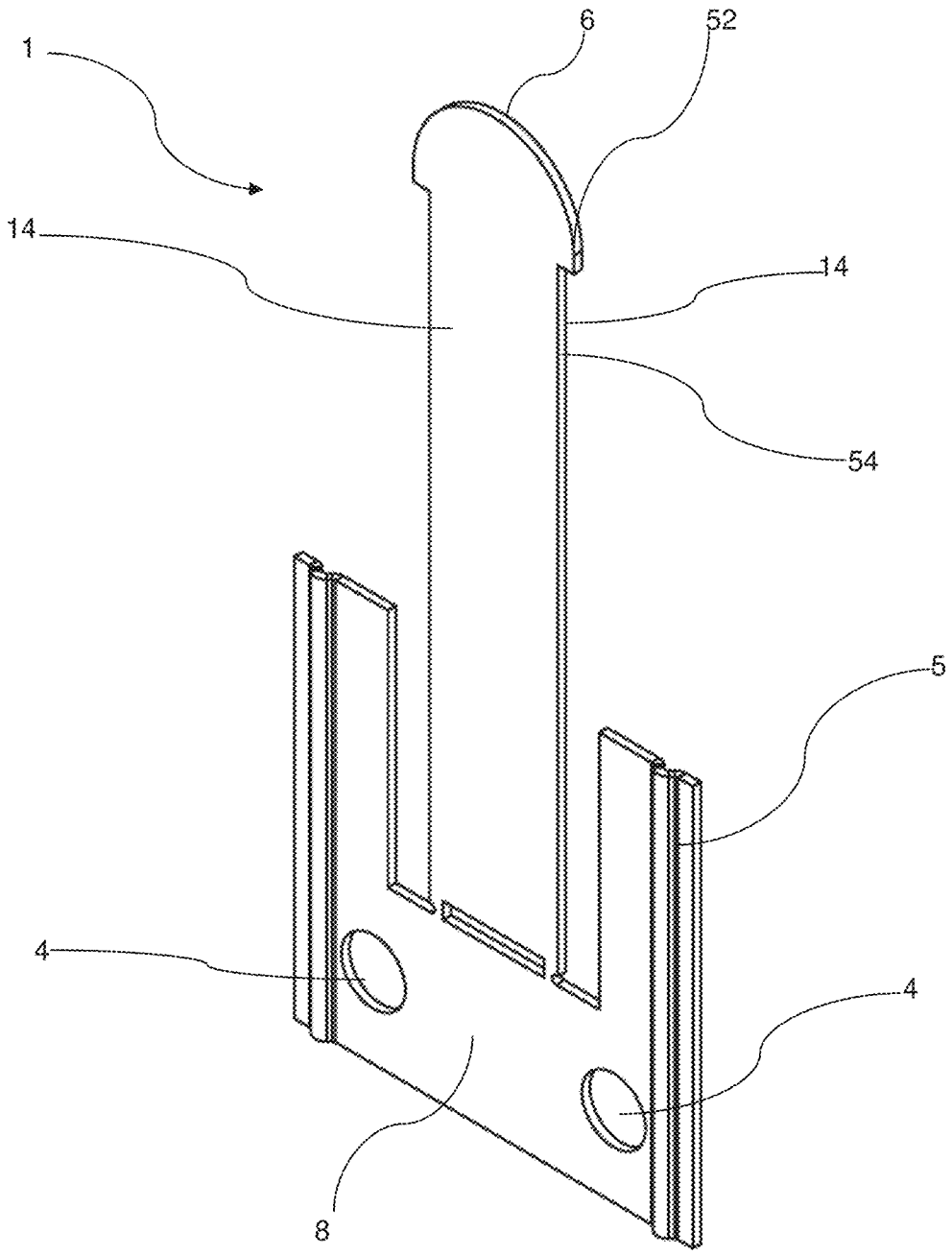
FIG. 6 shows another embodiment of the tile separator 1.

FIG. 6 discloses another embodiment of the tile separator 1.

It is shown in flat condition as in FIG. 1.

The tile separator 1 comprises a base part 8 with holes 4 and corrugations 5, however this embodiment does not contain wing segments 16.1. This is done to accommodate the need of some users, that find it preferable to have a setup with movement of joints.

The metal rod 6 comprises smooth opposed surfaces 14 as the metal rod 6 disclosed in FIG. 1, it differentiates itself by having a protruding structure 52, protruding from an intermediate portion 54. Hereby this embodiment can enter engagement with an engagement structure such as the one seen on the tile laying tool in FIG. 10.

Figure 8:
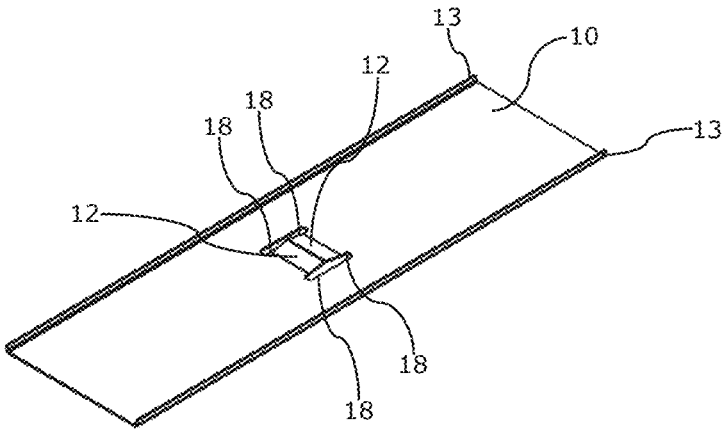
FIG. 8 shows the tile holder according to the invention in 3d view.

FIG. 8 shows the tile holder 10 according to an aspect of the invention in 3d view. The tile holder 10 is made from sheet metal, such as steel, which has been hardened to a certain resilience. The holder 10 has been punched out and provided with additional punched out openings 18 and folded edges 13. Two one-way jaws 12 are provided centrally in the steel plate, and each jaw is attached to the slate along a hinge line 11, such that each jaw 12 may be pressed upwards, as the material in and around the hinge line deforms elastically to allow this movement. This is used in that the metal rod 6 is inserted between the two jaws 12 by forcing the tile holder 10 down on the rod 6. This is shown in FIG. 6*a*, and the elastically deformed jaws will be urged back and thus pressed against the metal rod. An attempt to move the tile holder 10 upwards with respect to the rod, shall result in that the jaws are forced against each other and thus even further against the rod, whereas a downward movement is possible, as the jaws shall give way by a small elastic deformation in and around the hinge line 11. As the metal rod 6 is made from a relatively ductile material such as aluminium or similar, which is easily shaped by so named plastic deformation, whereby the edges at the jaws, which are shaped by the punch out process and thus naturally sharp, shall make indents in the aluminium rod element when a force is applied to the tile holder in an upward direction, when placed on the metal rod 6. Even if the metal rod 6 is very smooth at its opposed sides 14, the hardness of the one-way steel jaws 12 in comparison to the relative softness of the material of the metal rod 6 shall ensure, that the rod may only move one way, once placed between the steel jaws 12.

Figure 7:
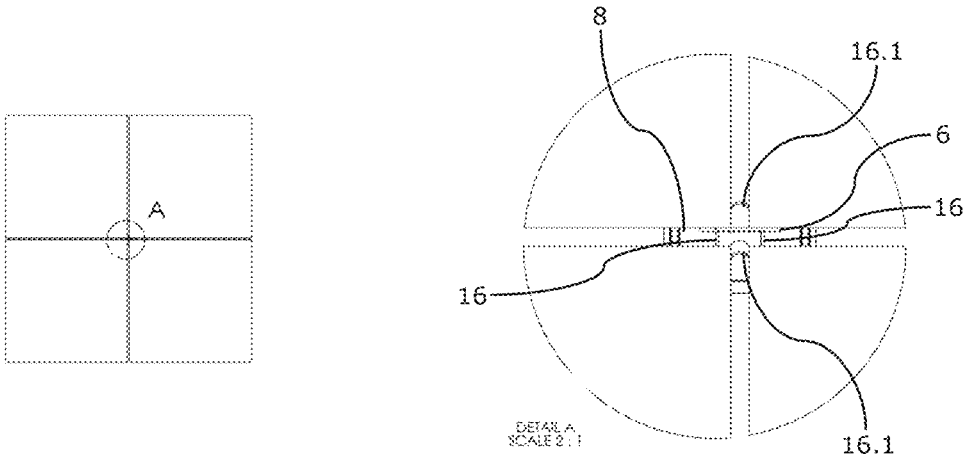
FIG. 7 is a tile separator 1 placed to keep the distance between four adjacent tiles, which are joined on a flat surface, side by side to form a cross.
Figure 9:
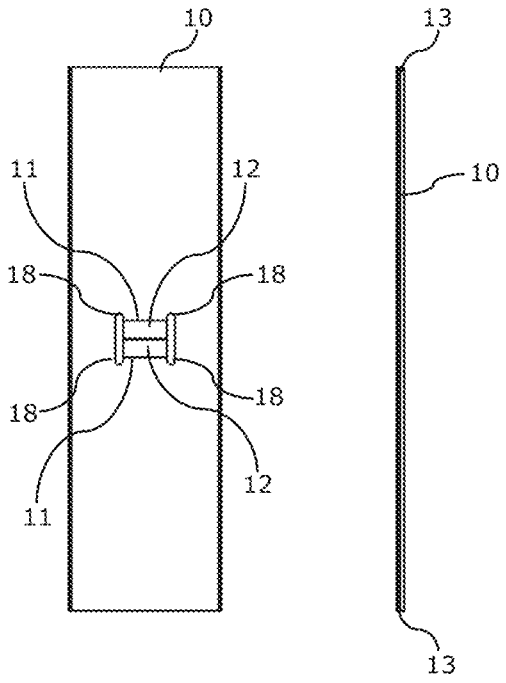
FIG. 9 shows the tile holder in FIG. 3 in plan view (left) and side view (right)

FIG. 9 shows the tile holder in FIG. 3 in plain view (left), side view (right), and end view (bottom) and as seen in FIG. 7 to the left, there are punched out through-going openings 18 at each side of each jaw 12, and these openings 18 shall allow the wing segments 16 of the metal rod 6 to pass here, such that a metal rod 6 with a tile holder 10 mounted thereon, which has been broken away from the tile layer after setting of the cement, may be pulled all the way through the one way jaw opening. This leaves the tile holder 10 free to be re-used. It also leaves the metal rod free to be discarded or collected for re-cycling of the metal contained therein.

Figure 10:
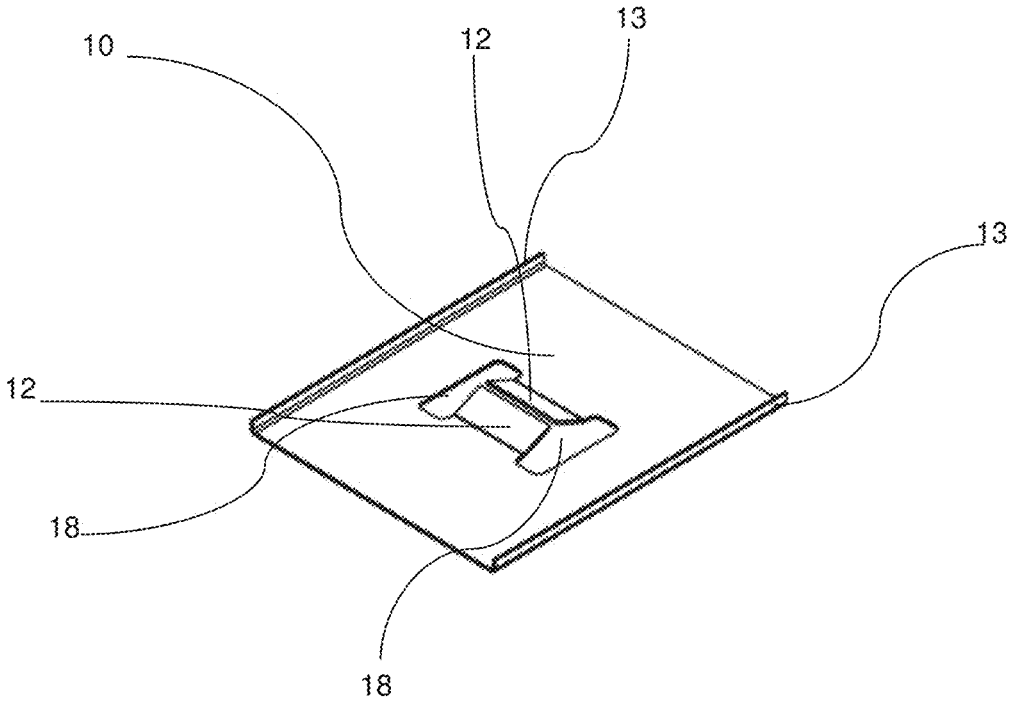
FIG. 10 shows another embodiment of a tile holder 10.

FIG. 10 discloses another embodiment of a tile holder 10 wherein the length of the tile holder 10 is shorter.

Figure 11:
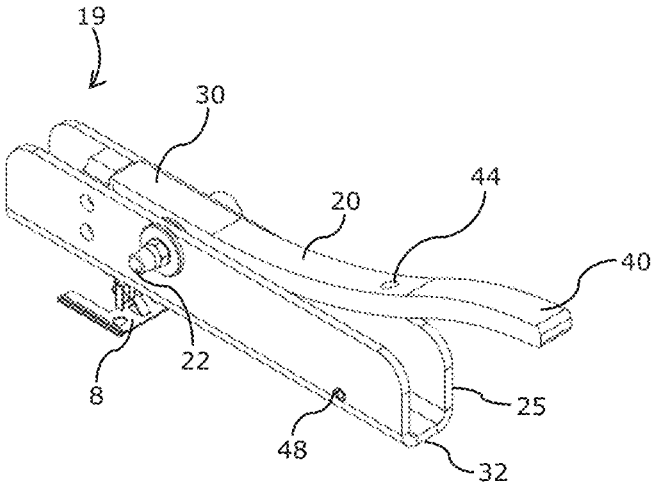
FIG. 11 shows a tile laying tool according to the invention in 3d rendition.

FIG. 11 shows a tile laying tool 19 in 3d representation according to an aspect of the invention. The tool 19 has a flat even side 32, adapted to be placed onto a tile surface, preferably of newly laid tiles, where the cement has not yet hardened. The flat even side 32 is part of a lever base 25 in which a lever 20 is arranged such that it may rotate or turn around a turning point 22 with respect to the lever base 25.

The lever 20 has two arms stretching in opposed directions from the turning point, where a short arm 30 stretches towards a support 28, and a long arm 40 which stretches away from the turning point and beyond the boundaries of the lever base 25. At the end of the short arm 30 towards the support, an engagement structure in the form of a range of teeth 50 are provided and arranged along the curvature of a circle 38. The circle has its center at the turning point 22. At the support 25 there is provided a hole 26 in the lever base, and the tile laying tool may now be placed onto a tile surface with a metal rod 10 protruding up through the hole 26 between the support 26 and the range of teeth 50.

When the lever 20 has been turned to a fully open position, the teeth 24 are all turned slightly away from the support 28, and the metal rod 6 may pass between the support and the short arm, until it reaches a stop element 34 provided as at an uppermost part of the short arm 30. As the long arm 40 is pressed downward from this position towards the tiles, as the tool rests thereon, the metal rod 6 shall be lifted by the teeth of the short arm 30 as they are pressed slightly into and make indents on the metal rod 6, with the support 28 as backing.

When a tile holder 10 is placed between the flat even side 32 and the tiles with the one-way jaws 10 on either side of the metal rod, the lifting force of the tool on the rod, shall translate to a pressure between the tile holder 10 and the base part 8, which will ensure, that the upper surface of the tiles shall be aligned with each other.

Figure 12:
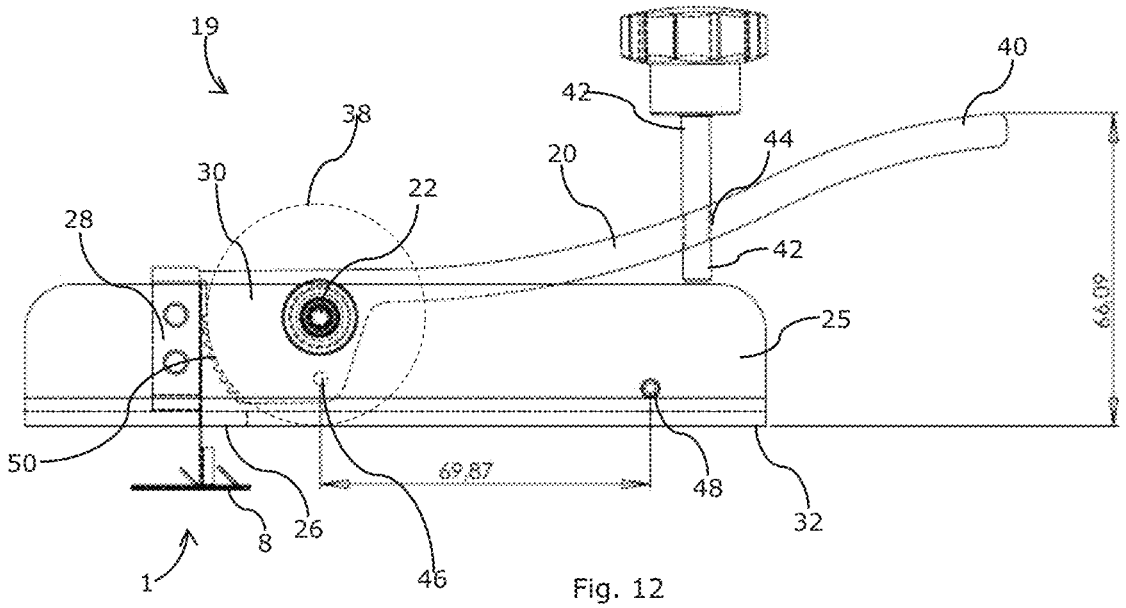
FIG. 12 is the tool from FIG. 11, seen in see through mode with the lever 20 in raised position.

In FIG. 12 the tool is shown with the long arm 40 in its top position, and it can be seen that this places the short arm 30 at its lowermost position. Here the stop element 34 of the short arm 30 shall receive the metal rod of the tile separator 1. As the long arm 40 is moved downwards to its lowermost position shown in FIG. 13, the short arm 30 pivots upwards, with the range of teeth 24 in tight connection with the rod 6, such that the rod 6 is moved with the teeth in an upward direction. As the underside 32 of the lever base 24 rests on the tile surface, this movement imparts a pressure force between the tile surface and a tile holder placed here and the base part 8.

A regulation screw 42 with a handle is provided in a hole 44 in the long lever arm 40, whereby it is ensured, that the long lever arm 40 is not moved too far downward, which might endanger the connection between the rod 6 and the base 8, causing the bridges 9 to snap before the tile cement has hardened.

A spring (not shown) may be inserted between the hole 46 in the short lever arm 30 and a throughgoing pin 48 in order to keep the lever arm 22 open, whenever it is not forced downward.

Figure 14:
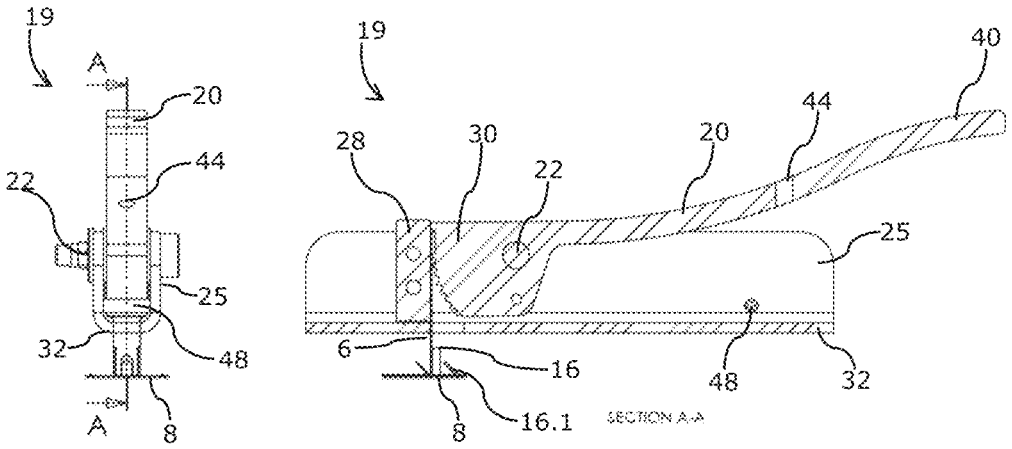
FIG. 14 shows an end view and a sectional view of the tool 19.

FIG. 14 shows an end view and a sectional view through the tool. In the end view to the left, it can be seen, that the lever base is a u-shaped profile, and the turning point of the lever is a shaft inserted perpendicular to the two branches of the u-shaped profile. The shaft is preferably formed by a bolt, and a fastening screw at one end thereof secures the bolt to the u-shaped profile.

With the aid of a tile laying assembly comprising the tile holder 10 and the one piece tile separator, the tiles may be laid with precision joints and using a simple tool 19 which could be shaped in many different ways, also it may be ensured, that the tiles are evenly laid without any level shifts over the joints.

Once tiles are laid in this way, the tool 19 may be removed, and the installed tightening force shall keep the tiles levelled during setting of the cement. When the cement has been sufficiently cured, the metal rod is pulled or knocked away from the base part. Now, as explained the metal rod 6 may easily be pulled up through the metal jaws to be released from the tile holder. The tile holder may be used many times over.

Figure 13:
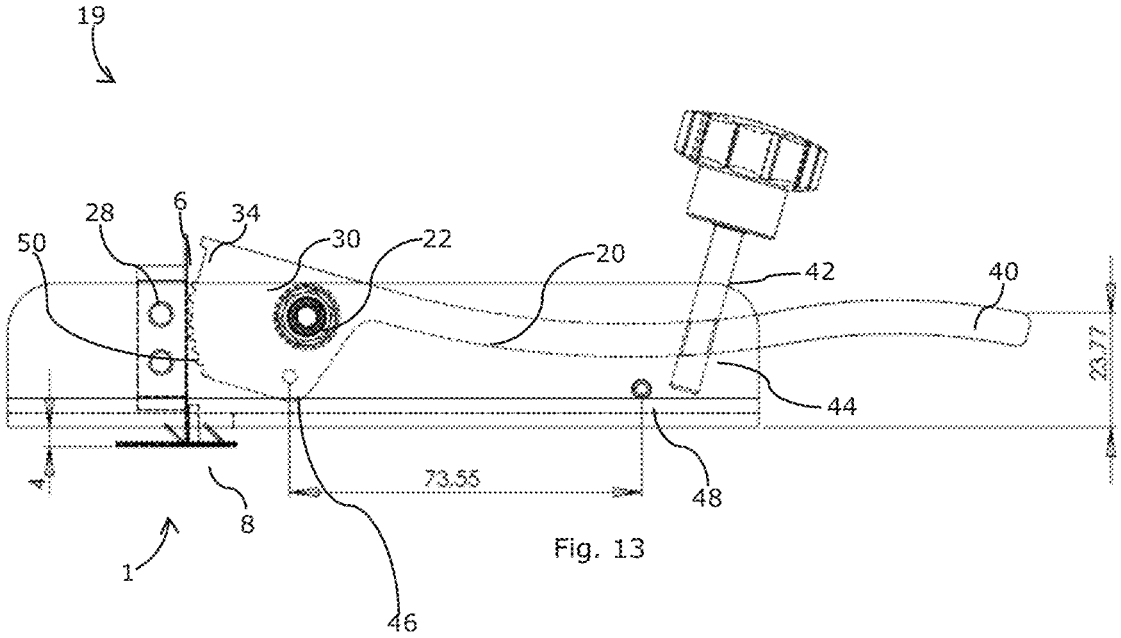
FIG. 13 shows the tool in FIG. 11 with the lever in a lowermost position.
Figure 15:
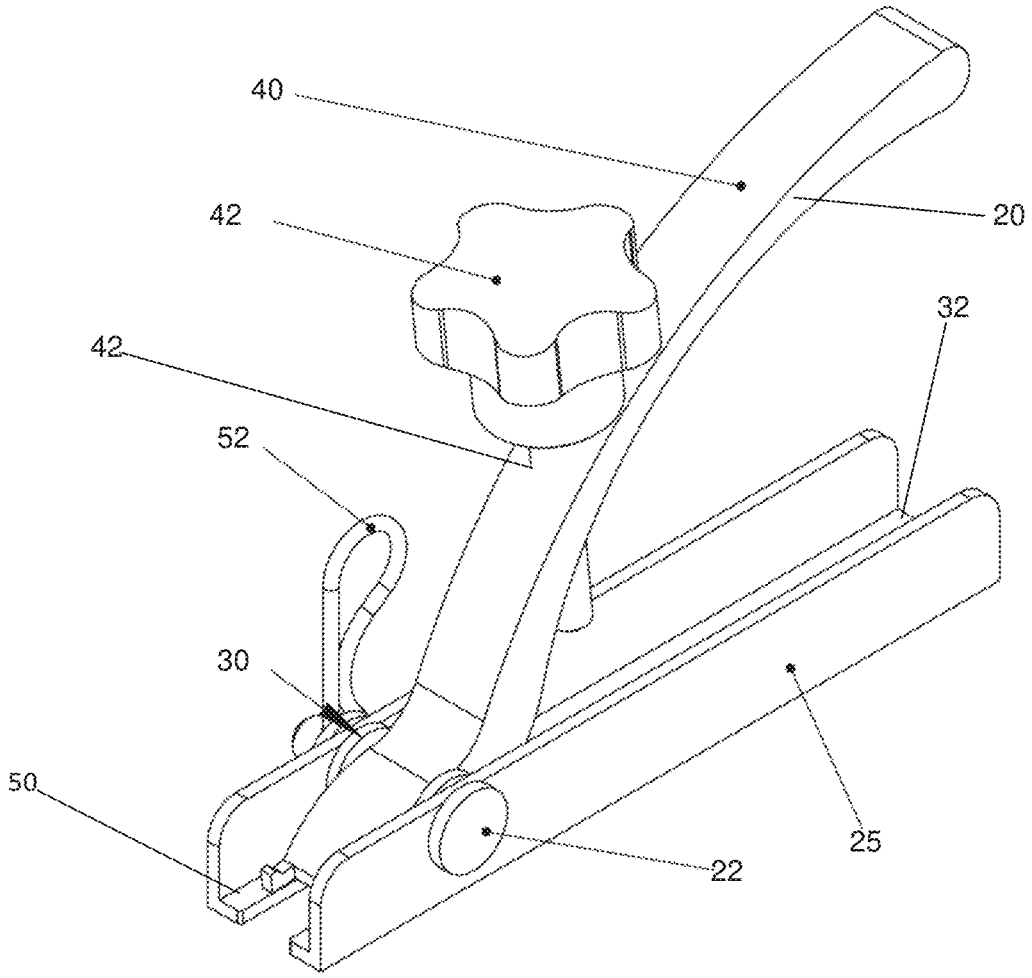
FIG. 15 shows another embodiment of the tile laying tool 19.

FIG. 15 shows another embodiment of the tile laying tool 19 similar to FIG. 13. The embodiment differentiates itself by having an engagement structure formed as a fork structure 50 which is configured and arranged to be engaged with a metal rod 6 with a protruding structure 52 as shown in FIG. 6. The tile laying tool 19 also has the feature of an attachable/detachable pin 56, the pin is arranged and configured such that when detached it remains attached to the axis it is attached to, hereby the tool can easily be dissembled for easy cleaning.

LIST OF REFERENCE NUMERALS

1—one-piece tile separator
2—Tile or coating element
4—Hole
5—Corrugations
6—Metal rod
8—Base part
9—Two bridges
10—Tile holder
11—Hinge line
12—One-way steel jaws
13—folded edges
14—Opposed smooth surfaces of the metal rod
16—Wing segments on the metal rod
16.1—Wing segments on the base part
18—Through going opening
19—Tile laying tool
20—Lever
22—Turning point
25—Lever base
26—Hole in the lever base
28—Support
30—Short arm
32—Flat even side
34—Stop element
36—Range of teeth
38—Circle
40—Long arm
42—Screw
44—Hole in long lever arm 40
46—hole in short lever arm 30
48—throughgoing pin
50—engagement structure
52—protruding structure
54—intermediate structure
56—detachably attached pin

What is claimed is:

1. A method for laying tiles where a separator is placed under, above, and between adjacent tiles during a process of cementing the tiles to a surface, the method comprising:

placing a metal rod of a one-piece tile separator between two adjacent tiles, with a metal base part under the adjacent tiles;

sliding a tile holder onto the metal rod, whereby one-way steel jaws opposite each other in the tile holder are pressured towards two opposed smooth surfaces of the metal rod; and preventing return movement of the tile holder along the metal rod while the opposed one-way steel jaws indent a soft metal surface of the metal rod.

2. The method according to claim 1, further comprising erecting a metal rod of the one-piece tile separator with respect to a base part of the one-piece tile separator by bending the metal rod relative to the base part at a prearranged bending line.

3. The method according to claim 1, further comprising:

adding a predefined tightening force between an outer end of the rod and the tile holder by pulling the rod with a predefined pull force away from the tiles, and pressuring the tile holder downward towards the tiles with a similar but opposed force whereby the metal base part and the tile holder are urged towards each other from either side of the tiles; and releasing the pull force between the outer end of the metal rod and the tile holder, while the pressure between the tile holder and the base part are maintained due to the indent of the soft metal surface of the metal rod.

4. The method according to claim 3, wherein the predefined tightening force is applied to the metal rod by action of at least one lever with a short arm and a long arm, whereby the at least one lever is turned with respect to a turning point, whereby the turning point is mounted in a lever base such that the short arm of the lever comprising an engagement structure shall lift the metal rod with respect to the tile holder, while the long arm of the lever is moved towards the tiles, wherein the engagement structure is a structure that engages with and is detachably attached to the metal rod.

5. The method according to claim 4, wherein the engagement structure is a range of teeth arranged and configured to be brought into engagement with the metal rod.

6. The method according to claim 4, wherein the engagement structure is a fork structure arranged and configured to be brought into engagement with a corresponding engagement member of the metal rod.

7. The method according to claim 4, wherein the lever base is placed on a tile surface with the metal rod protruding through a hole in the lever base and the lever base is pressured towards the tiles while the long arm is moved toward the tiles to provide a lifting force on the metal rod with respect to the metal base part.

8. A tile laying assembly comprising:

a metal base part;

a metal rod integrally shaped with and erected from the metal base part; and a tile holder comprising one-way steel jaws adapted to receive the metal rod and allow movement of the metal rod in only one direction;

wherein the metal rod comprises two opposed smooth surfaces made from a softer metal than the one-way steel jaws and adapted to be indented by the one-way steel jaws.

9. The tile laying assembly according to claim 8, wherein the metal rod comprises an intermediate member and a protruding portion.

10. The tile laying assembly according to claim 8, wherein the metal base part and the metal rod both comprise integral first wing segments adapted to be placed between adjacent tiles in order to ensure a uniform distance between tiles.

11. The tile laying assembly according to claim 10, wherein the first wing segments on the metal rod protrude perpendicularly away from the smooth surface thereof proximal to the base part.

12. The tile laying assembly according to claim 10, wherein second wing segments protrude at an upward angle from the metal base part, are disposed at either side of the metal rod, and extend in a plane which is perpendicular to an extension plane of the first wing segments.

13. The tile laying assembly according to claim 8, wherein the metal rod and the metal base part are punched out in one piece from an aluminium sheet metal blank.

14. The tile laying assembly according to claim 8, wherein the tile holder is punched out from a steel sheet metal blank.

15. The tile laying assembly according to claim 8, wherein the one-way steel jaws of the tile holder comprise adjacently positioned opposed individual flaps angled upwards with respect to a tile contacting surface that are spaced apart to accommodate the metal rod.

16. A one piece tile separator comprising:

a metal rod and a metal base part that are integrally shaped, wherein the metal rod and the metal base part are arranged in the same extension plane;

a connection line between the metal base part and the metal rod; and wing segments provided at the metal rod protruding at a normal to the extension plane of the metal rod, such that when the metal rod is tilted to be erected in order to be aligned with a normal to the metal base part, the wing segments provide a tilting guide.

17. A tile holder configured to be used in a tile laying assembly comprising:

a punched-out steel sheet element having two opposed one-way steel jaws that are angled upward from a steel sheet plane; and through-going openings at each side and adjacent to the one-way steel jaws.

18. A tile laying tool configured to be arranged and to apply a tightening force to a metal rod of a tile laying assembly, the tile laying tool comprising:

a lever with a short arm and a long arm arranged to pivot around a turning point with respect to a lever base that has a flat side and a hole in the flat side;

wherein the short arm comprises:

a range of teeth disposed near the hole and arranged on a circumference of a circle that is concentric with the turning point; or a fork structure arranged and configured to be brought into engagement with a corresponding engagement member of the metal rod.

19. The tile laying tool according to claim 18, further comprising a regulation screw that is rotatably mounted in the long lever arm, wherein a distal end of the regulation screw is configured be brought into contact with the lever base to prevent further movement of the lever.

20. The tile laying tool according to claim 18, further comprising a pin facilitating disassembly of the tile laying tool.

* * * * *